US009429307B1

(12) United States Patent
Kathawate et al.

(10) Patent No.: US 9,429,307 B1
(45) Date of Patent: Aug. 30, 2016

(54) COMPACT SYSTEM FOR CONNECTING AN ELECTRICAL SUPPLY TO A LIGHTING SYSTEM

(71) Applicants: Jyoti Kathawate, Smyrna, GA (US); Jason Paulsel, Peachtree City, GA (US); Steven Pyshos, Peachtree City, GA (US)

(72) Inventors: Jyoti Kathawate, Smyrna, GA (US); Jason Paulsel, Peachtree City, GA (US); Steven Pyshos, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 152 days.

(21) Appl. No.: 14/182,197

(22) Filed: Feb. 17, 2014

(51) Int. Cl.
*F21V 23/06* (2006.01)

(52) U.S. Cl.
CPC ..... *F21V 23/06* (2013.01)

(58) Field of Classification Search
CPC ..... F21V 23/06; F21V 21/04; F21S 8/026; F21S 8/02
See application file for complete search history.

(56) References Cited

U.S. PATENT DOCUMENTS 8,882,308 B2 * 11/2014 Cho ..... F21V 21/04 362/364
2008/0304269 A1 * 12/2008 Pickard ..... F21V 21/048 362/365
2014/0268767 A1 * 9/2014 Hatch ..... F21V 15/01 362/249.02

* cited by examiner

*Primary Examiner* — Robert May
(74) *Attorney, Agent, or Firm* — King & Spalding LLP

(57) ABSTRACT

A connection to an electrical supply for a lighting system can be configured to facilitate deployment of the lighting system in a cramped space, for example in a shallow overhead plenum. The lighting system can comprise a housing for the light source. One or more sides of the housing can extend about the light source, for example circumferentially around the light source or otherwise laterally enclosing the light source. The electrical connection can be provided at a side of the housing, resulting in a low profile.

14 Claims, 8 Drawing Sheets

COMPACT SYSTEM FOR CONNECTING AN ELECTRICAL SUPPLY TO A LIGHTING SYSTEM

FIELD OF THE TECHNOLOGY

The present technology relates to lighting systems and more particularly to a system for connecting an electrical supply to a lighting fixture.

BACKGROUND

Installation of conventional lighting fixtures in cramped spaces is often challenging due to fixture size and awkward electrical connections. With conventional technology, a connection between an electrical supply and a lighting fixture housing can be unwieldy due to jutting connectors extending beyond available space.

Improved technology for connecting lighting fixtures to electrical supplies is needed. Need exists for a lighting connection system that is compact. Need exists for a lighting connection system that is low profile. Need exists for a lighting connection system that is suited for deployment in a plenum that is shallow or otherwise space restricted. Need exists for a lighting connection system that is economical or cost effective. Need exists for a lighting connection system that is installed readily, quickly, or economically. Need exists for a lighting connection system that is quick-connect or quick-disconnect. A capability addressing one or more such needs, or some other related deficiency in the art, would support illumination systems in multiple applications and deployment scenarios.

SUMMARY

A connector can provide a lighting system with connectivity to an electrical supply.

In one aspect, a lighting fixture can comprise a housing in which a light source is disposed. The housing can comprise a lower portion, an upper portion, and a side portion. The light source can be disposed between the lower portion of the housing and the upper portion of the housing. The side portion of the housing can extend between the upper and lower portions of the housing and about the housing. Thus, the side portion can span either the entire distance from the lower portion to the upper portion or a fraction of the entire distance. Light can emit from the lower portion of the housing into an area to be illuminated. Connectivity to the electrical supply can be provided via the side portion of the housing, resulting in a compact or low profile lighting system.

The foregoing discussion of lighting system connection is for illustrative purposes only. Various aspects of the present technology may be more clearly understood and appreciated from a review of the following text and by reference to the drawings and the claims that follow. Other aspects, systems, methods, features, advantages, and objects of the present technology will become apparent to one with skill in the art upon examination of the following drawings and text. It is intended that all such aspects, systems, methods, features, advantages, and objects are to be included within this description, covered by this document, and protected by the accompanying claims.

Figure 1:
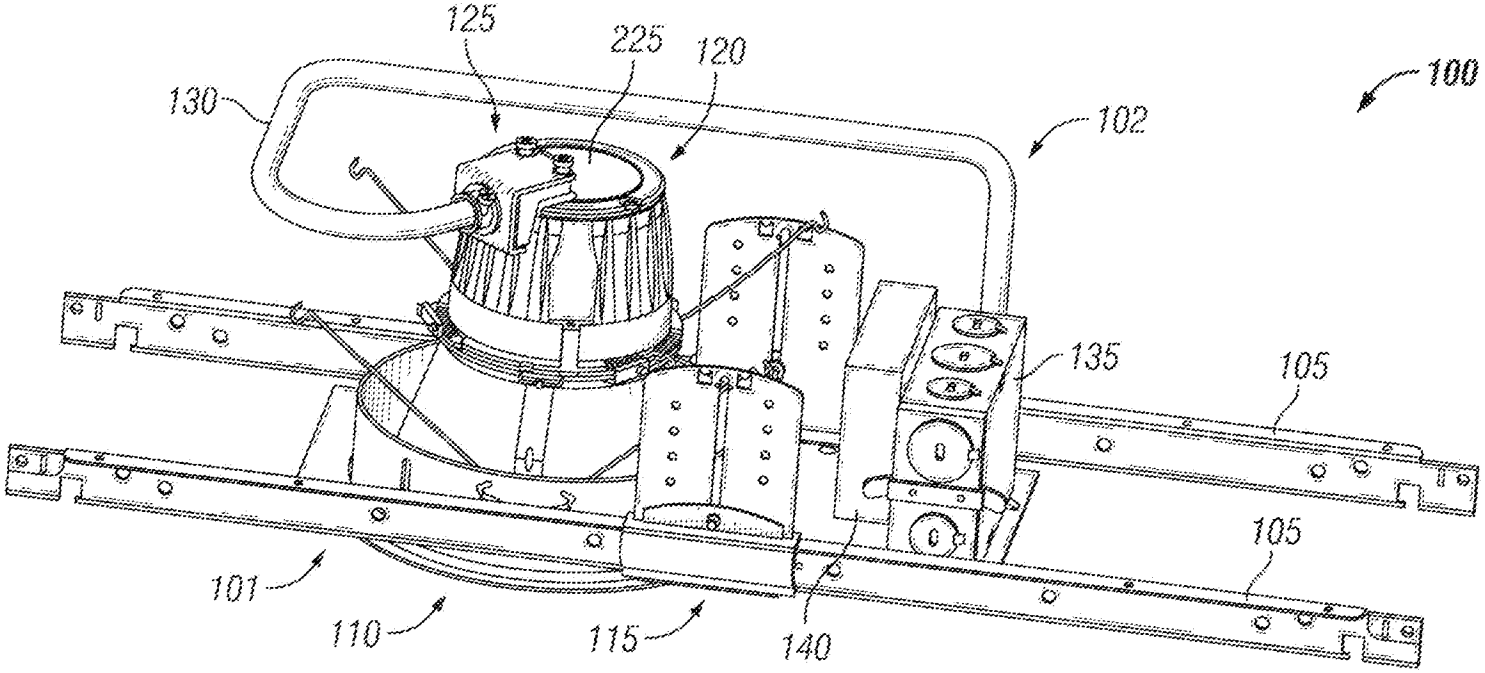
FIG. 1 illustrates, in perspective view, a representative lighting system that comprises an electrical connection system according to some example embodiments of the present technology.

Many aspects of the technology can be better understood with reference to the above drawings. The elements and features shown in the drawings are not necessarily to scale, emphasis being placed upon clearly illustrating the principles of example embodiments of the present technology. Moreover, certain dimensions may be exaggerated to help visually convey such principles.

DESCRIPTION OF EXAMPLE EMBODIMENTS

A lighting system can be connected to an electrical supply. The connection can facilitate or support deployment of the lighting system in a cramped space, for example in a shallow overhead plenum. The lighting system can comprise a housing for a light source. One or more sides of the housing can extend about the light source, for example circumferentially around the light source or otherwise laterally enclosing the light source. The connection to the electrical supply can be provided at a side of the housing, resulting in a low profile and/or a compact format.

The present technology can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples," "embodiments," "example embodiments," or "exemplary embodiments" given herein are intended to be non-limiting and among others supported by representations of the present technology.

Connection technology for lighting systems will now be described more fully with reference to FIGS. 1-7, which describe representative embodiments of the present technology and illustrate various elements and views of a representative lighting system.

Turning now to FIG. 1, this figure is a perspective view illustration of an example lighting system 100 that comprises an example electrical connection system 125 in accordance with some embodiments of the present technology. The illustrated lighting system 100 provides an example of a lighting fixture incorporating the electrical connection system 125. As will be discussed in further detail below with reference to subsequent figures, the electrical connection system 125 comprises a two-part, male-female electrical connector disposed within and protected by a mechanical connector.

In the illustrated embodiment, the lighting system 100 comprises a plaster frame 101 with accompanying hangar bars 105 to facilitate overhead mounting, for example recessed in a ceiling. Installation personnel can utilize a mechanical adjustment system 115 to tailor the system 100 according to installation specific mechanical and optical parameters. Other embodiments may be deployed in different overhead applications, mounted to a vertical surface, or otherwise deployed, without limitation. As will be discussed in further detail below, the example electrical connection system 125 is side oriented to facilitate installation, mounting, or deployment in cramped spaces, such as in shallow plenums.

In some example embodiments, the lighting system 100 may not include a plaster frame. To mention a representative example without limitation, the present technology can be readily utilized in remodel construction applications where a plaster frame does not exist.

In addition to mounting facilities, the illustrated lighting system 100 comprises a housing 120 for a light source (hidden from view in FIG. 1). In various embodiments, the light source may comprise one or more light emitting diodes (LEDs), one or more incandescent lamps, one or more fluorescent bulbs, compact fluorescent light sources, or some other appropriate lighting technology. Beyond the illustrated plaster frame application, the housing 120 can be deployed in various other lighting applications.

As illustrated, the housing 120 is mounted with a reflector 110 that delivers light to an area to be illuminated, such as into a workspace, office, home, or studio, for example. In various embodiments, the reflector 110 may comprise one or more optical surfaces that may be diffusely reflective or specularly reflective, for example. In some example embodiments, the reflector 110 is funnel shaped so that the reflective surface tapers out towards the area to be illuminated. In some embodiments, the reflector 110 can be or comprise a lower part of the housing 120.

The housing 120 may be viewed as having a lower end and an upper end, with the reflector 110 at the lower end and a cover 225 at the upper end. Those skilled in the art will appreciate that such upper and lower designations are used without implying that the housing 120 would necessarily be installed with the cover 225 up and the light emitting end down. For example, in a wall-mount scenario, a structure other than the plaster frame 101 might be utilized, and the cover 225 might be horizontal to the light emitting end. And in some other embodiments, the housing 120 may be mounted so that light emits skyward. Accordingly, in some installations, the lower end of the housing 120 may be at a higher elevation than the upper end of the housing 120 or the two ends may be at substantially equal elevations.

The illustrated lighting system 100 comprises an example electrical supply system 102. As illustrated, the example electrical supply system 102 comprises a junction box 135 in which an alternating current (AC) supply line (not illustrated) is connected or terminated during installation. The supply line may carry 110 VAC (volts alternating current), for example. A power supply 140 is mounted adjacent the junction box 135 and converts the incoming AC electricity into an appropriate format for delivery to the light source. In the example of a light emitting diode based light source, the power supply 140 may comprise a driver that supplies direct current (DC) electricity or pulsed electricity, for example. In some example embodiments (not illustrated), a driver or other electrical power supply system is mounted at the upper end of the housing 120. In various embodiments, the electrical supply system 102 can receive and/or deliver a wide variety of forms of electricity, including high voltage, low voltage, AC, DC, pulsed voltage, etc. as may be useful for applications involving compact fluorescent lamps (CFLs), LEDs, incandescent lights, and other light sources, to mention a few representative examples without limitation.

A conduit 130 houses and carries electrical lines (not visible in FIG. 1) that extend from the power supply 140 to the housing 120 and conduct electricity for powering the light source. The conduit 130 is typically flexible, for example metallic interlock conduit, with the metallic composition providing electrical conductivity for an electrical ground. That is, ground current, if present, may flow along the conduit 130 via the conduit's metal composition. Other embodiments may utilize other conduits or tubes for housing electrical lines. Such conduits may be rigid in some embodiments and flexible in other embodiments and may be either conductive or nonconductive. A conduit composed of electrically insulating material may carry a dedicated ground wire in addition to wires forming an electrical supply circuit, for example.

Figure 2:
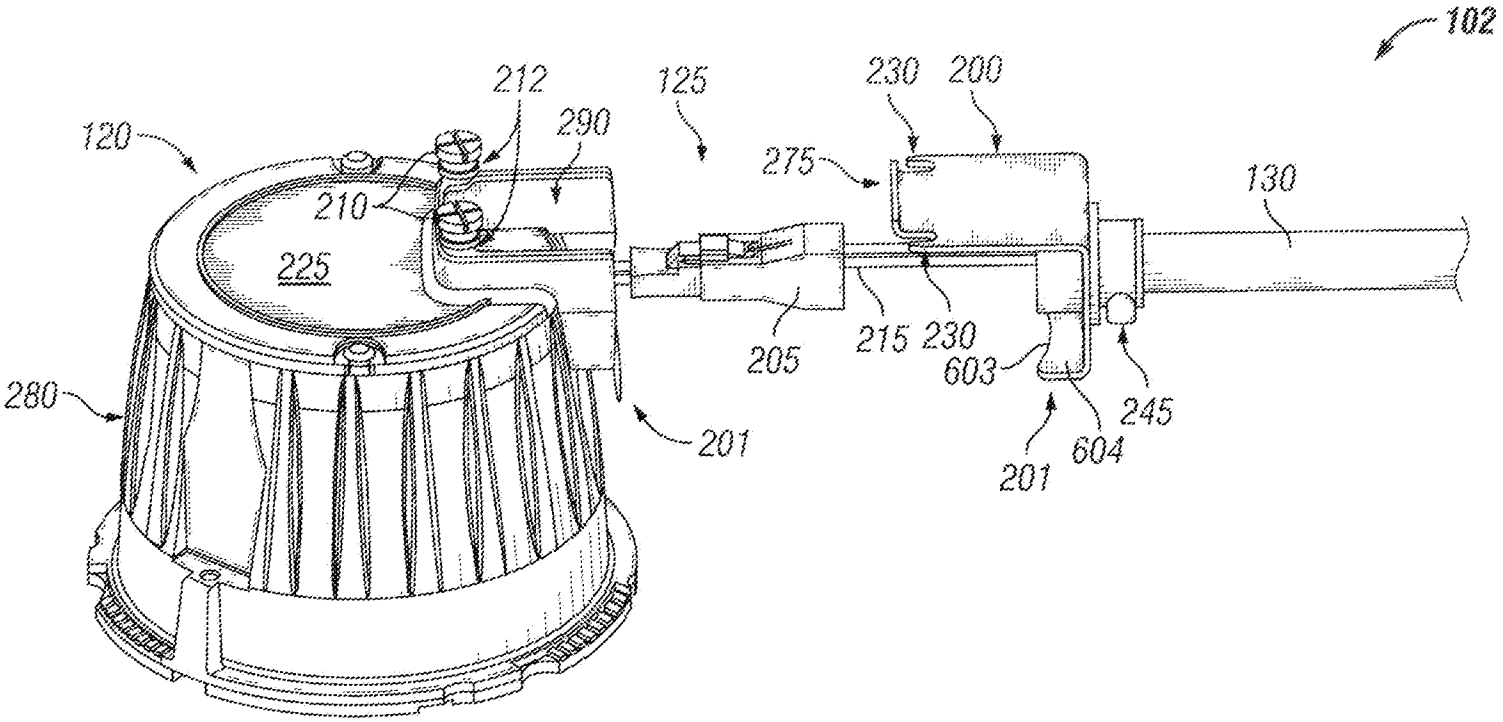
FIG. 2 illustrates the electrical connection system for connecting a light housing to an electrical supply, with the connection in a partially connected state, according to some example embodiments of the present technology.
Figure 3:
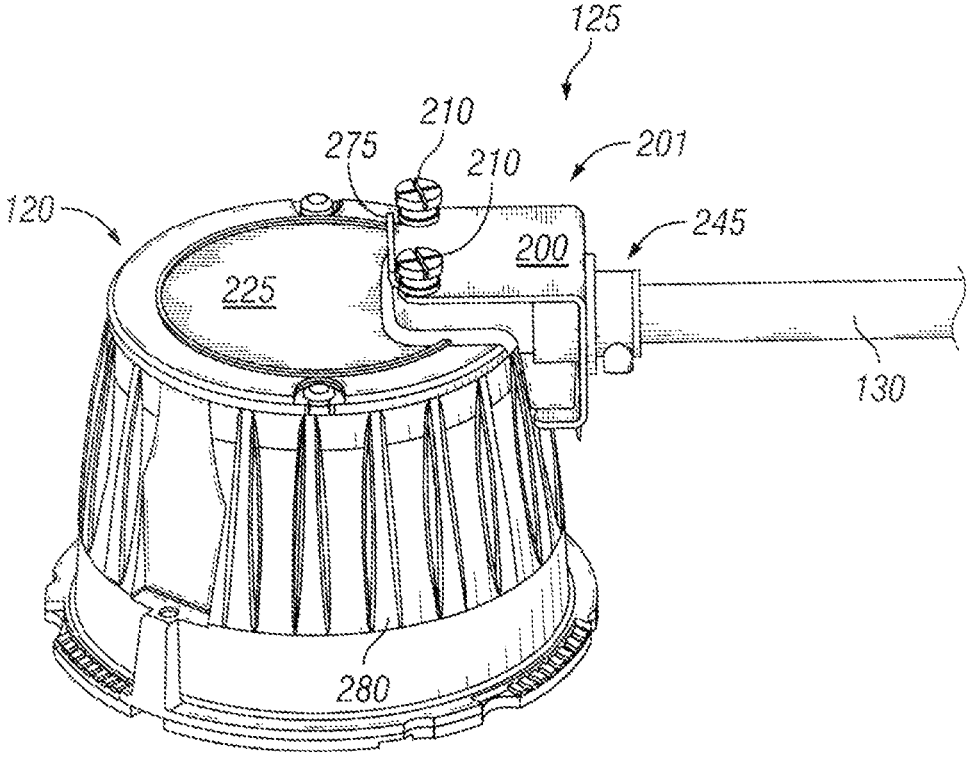
FIG. 3 illustrates the electrical connection system with the connection in a fully connected state according to some example embodiments of the present technology.

Turning now to FIGS. 2 and 3, FIG. 2 is an illustration of the example electrical connection system 125 for connecting the light housing 120 to the electrical supply system 102, with the connection in an example partially connected state, in accordance with some embodiments of the present technology. Meanwhile, FIG. 3 is an illustration of the example electrical connection system 125 with the connection in an example fully connected state in accordance with some embodiments of the present technology.

As discussed above with reference to FIG. 1 and as shown in FIG. 2, the electrical lines 215 run through the conduit 130 to provide electricity for the light source that is in the housing 120. The electrical connection system 125 comprises an electrical connector 205 encased by a mechanical connector 201 that couples the conduit 130 to the housing 120.

In the illustrated embodiment, the electrical connector 205 has a two-part, plug-and-socket configuration that supports quick connection and disconnection of the electrical supply circuit. The electrical connector 205 is typically installed on the electrical lines 215 during manufacture of the lighting system 100, but alternatively may be field installed.

In some embodiments, a manufacturer can supply the housing 120 with a male connector on a pigtail segment of the electrical lines 215. Thus, as shipped, a segment of connectorized electrical lines can dangle from the housing 120. Similarly, the manufacturer may provide other elements of the electrical supply system 102 with a mating female connector on another segment of electrical lines. In this manner, acquirers may purchase lighting system elements that are compatible with one another and may configure lighting systems flexibly according to customer preferences and installation parameters. Thus, the electrical connection system 125 and the electrical connector 205 can support interchangeability of lighting system components. Additionally, field personnel can wire (and unwire) the lighting system 100 readily, efficiently, and economically; including during installation, trouble shooting, maintenance, service, upgrade, or other field operation or procedure.

As one alternative to the illustrated electrical connector 205, the electrical connections can be made using lever nuts, push-in connectors, or other appropriate electrical connection technology known in the art.

In the illustrated example embodiment, the mechanical connector 201 houses and provides mechanical and environmental protection for the electrical connector 205 and associated electrical lines 215. In addition to mechanical and environmental protection, the illustrated mechanical connector 201 provides an electrical ground between the conduit 130 and the housing 120. In other words, the mechanical connector 201 provides an electrical path to conduct ground current as needed. The ground path can comprise metal-to-metal contact of adjoining elements, for example.

In the illustrated example embodiment, the mechanical connector 201 comprises a bracket 200. The bracket 200 attaches on one side to the conduit 130 via a clamp 245. Opposite the clamp 245, the bracket 200 attaches to the housing 120 at an aperture 290. The bracket 200 comprises two apertures 230 and an adjacent bent lip 275 facing the housing 120. In the illustrated embodiment, the apertures 230 comprise slots but in other embodiments may take other appropriate forms.

In the illustrated embodiment, the bracket 200 bends over a cover 225 of the housing 120, and two fasteners 210 attach to the cover 225 adjacent the aperture 290. In some example embodiments, the fasteners 210 comprise threaded screws that engage corresponding threaded holes in the cover 225 of the housing 120 and have corresponding lock washers, O-rings, polymer inserts, or other appropriate retaining elements.

To make up the mechanical connection, an installer can loosen the fasteners 210 to provide a gap 212 under the fastener heads, as illustrated in FIG. 2. The installer can insert the bent lip 275 of the bracket 200 into the gap 212, with the fasteners 210 in the corresponding apertures 230 of the bracket 200. The installer can finger tighten one or both fasteners 210 so that the fastener heads capture the bent lip 275 of the bracket 200 as the gap 212 closes.

In some embodiments, the gap 212 under the fastener heads can be set at the factory so that the bent lip 275 of the bracket 200 is captured upon insertion, without necessarily tightening the fasteners 210 to close the gap 212. For example, the gap 212 can be set so that in order to insert the bent lip 275 into the gap 212, the installer would tilt the bracket 200 up (relative to the orientation shown in FIG. 2) and finesse the leading edge of the bent lip 275 into the gap 212. Once the installer maneuvers the bracket 200 into this gap 212, the installer can allow the bracket 200 to tilt back to its relaxed, operating orientation (for example the angular position illustrated in FIGS. 2 and 3). In this orientation, the fastener heads capture the bent lip 275 and retain the bracket 200 with the gap 212 factory-set.

With the bracket 200 captured by the fasteners heads, whether via finger tightening or by finessing into a preset gap 212, the installer can tighten the fasteners 210 using a screwdriver or other appropriate tool hand tool. So tightened, the fasteners 210 retain the bracket 200 in an operational configuration, for example as illustrated in FIG. 3.

In the illustrated example configuration, the bracket 200 extends along the side of the housing 120, adjacent heat sink fins 280 of the housing 120, past a corner of the housing 120, and over the cover 225 of the housing 120. An extension 604 on the bracket 200 buts up to the side of the housing 120 and has an edge 603 that is curved to distribute contact along the housing periphery. In other embodiments, the extension 604 may have a linear edge, for example for contact with a flat side of a rectangular housing.

As illustrated, the electrical connection system 125 protrudes or juts from the side of the housing 120, thereby facilitating mounting in limited access spaces, such as in a shallow overhead plenum or recessed in a wall. In the illustrated embodiment, the electrical connection system 125 (specifically the mechanical connector 201) protrudes from the cover side of the housing 120. However, other embodiments may have the electrical connection system 125 in other locations. For example, in some embodiments, the electrical connection system 125 can be located towards the middle of a side of the housing 120, at the light emitting end of the side of the housing 120, or at some other appropriate side location. In various embodiments, one or more housing sides may have a geometry that is flat, oblong, tapered, cylindrical, square, rectangular, planar, or some other appropriate geometric form.

Figure 4A:
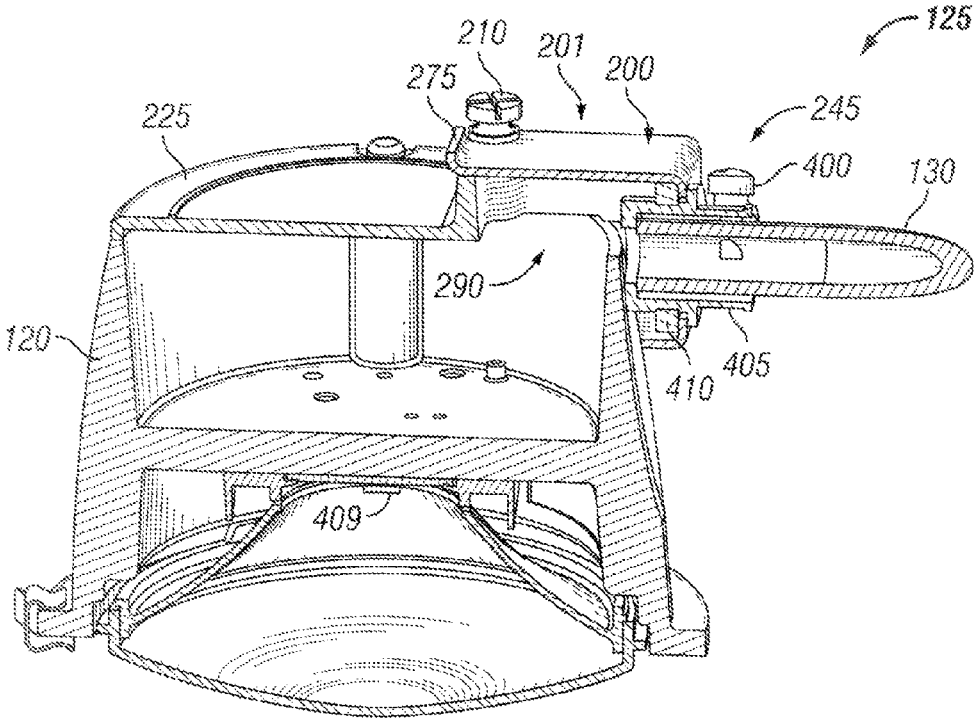
FIGS. 4A and 4B (collectively FIG. 4) illustrate two perspective, cut-away views of the electrical connection system with the connection in a fully connected state according to some example embodiments of the present technology.
Figure 4B:
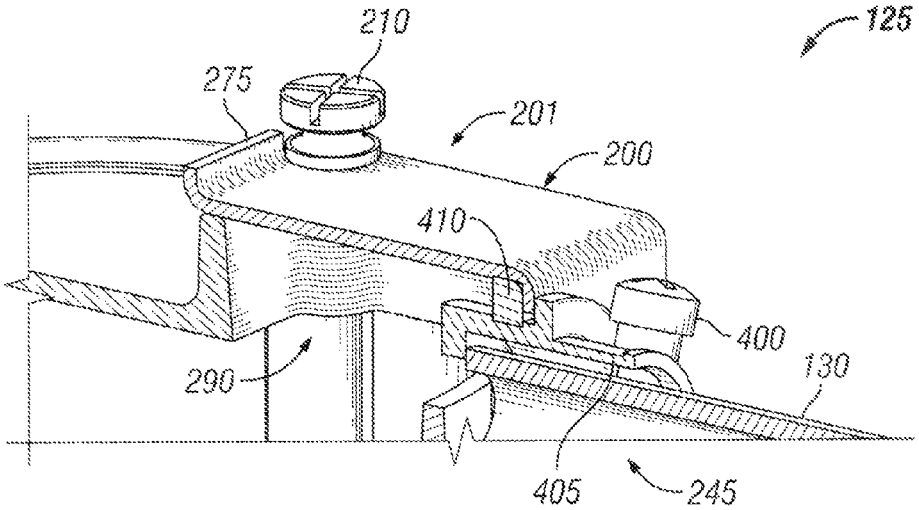

Turning now to FIG. 4, this figure provides illustrations, specifically two perspective, cut-away views, of the example electrical connection system 125 with the connection in an example fully connected state in accordance with some embodiments of the present technology.

The views of FIG. 4 illustrate in further detail an example of how the fasteners 210 and the bent lip 275 can cooperatively retain the bracket 200 and cover the aperture 290 in the illustrated embodiment. FIG. 4 additionally illustrates how the conduit 130 and the mechanical connector 201 provide a channel through which the connectorized electrical lines 215 (not illustrated in FIG. 4) extend to supply power for the light source 409.

As illustrated in FIG. 4, an example embodiment of the clamp 245 embraces and holds the conduit 130 to the bracket 200. The illustrated clamp 245 comprises a screw 400, a jam nut 410, and an associated coupler 405, as discussed in further detail below with reference to subsequent figures.

Figure 5A:
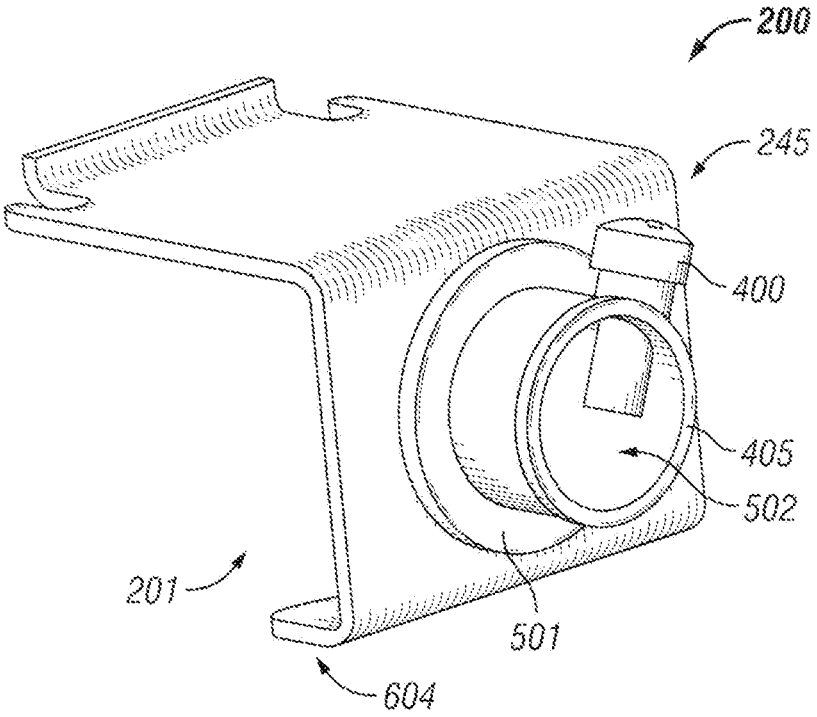
FIGS. 5A and 5B (collectively FIG. 5) illustrate two perspective views of a bracket coupled with a conduit fastening system of the electrical connection system according to some example embodiments of the present technology.
Figure 5B:
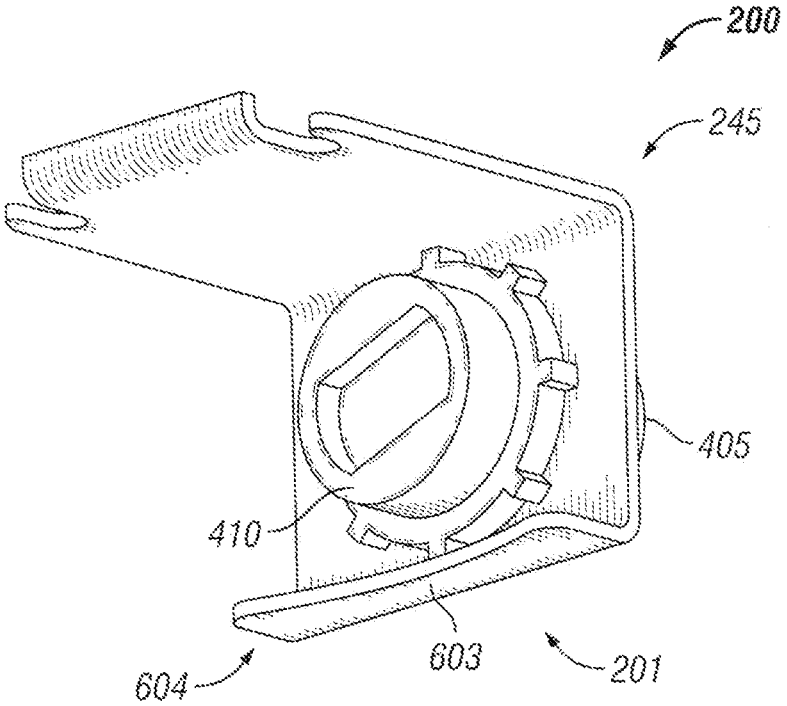
Figure 6A:
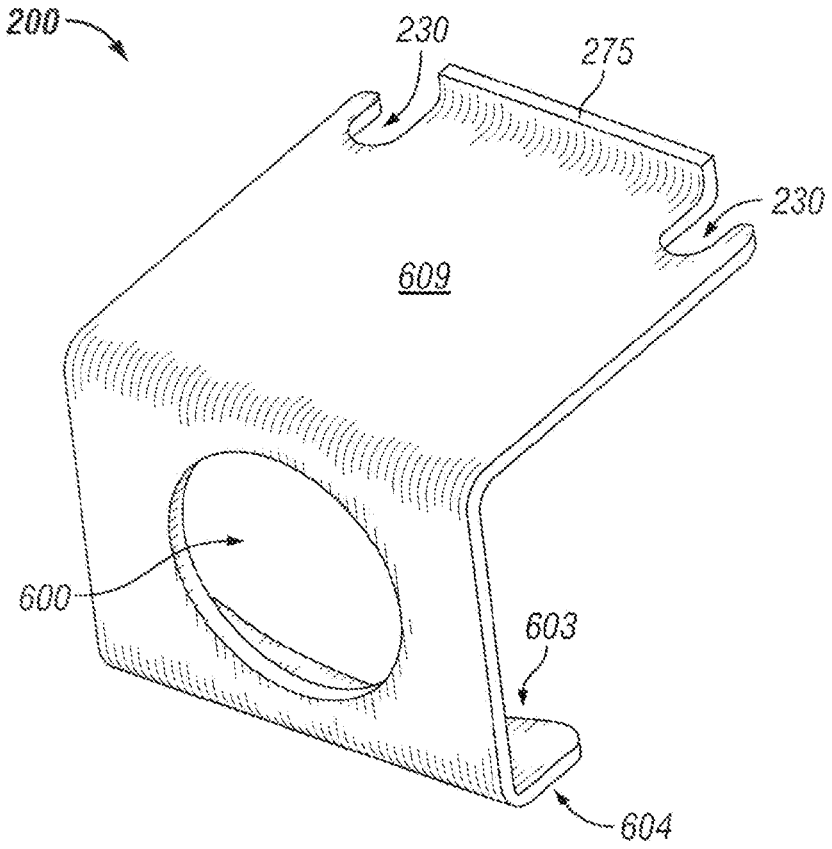
FIGS. 6A, 6B, 6C, and 6D (collectively FIG. 6) illustrate orthonormal and perspective views of the bracket of the electrical connection system according to some example embodiments of the present technology.
Figure 6B:
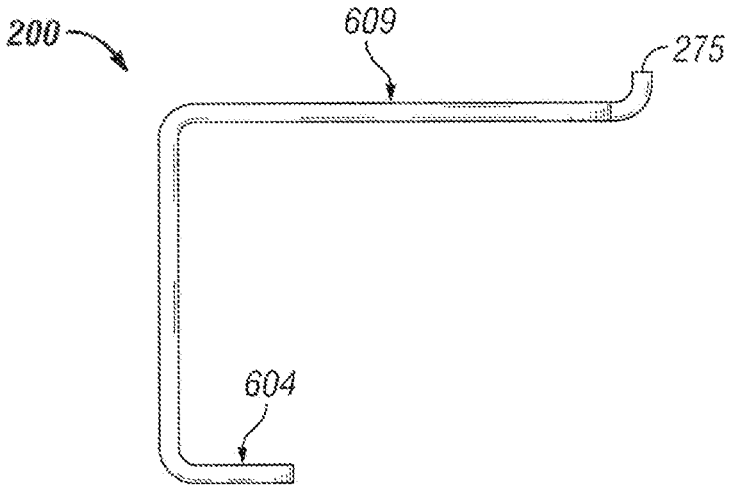
Figure 6C:
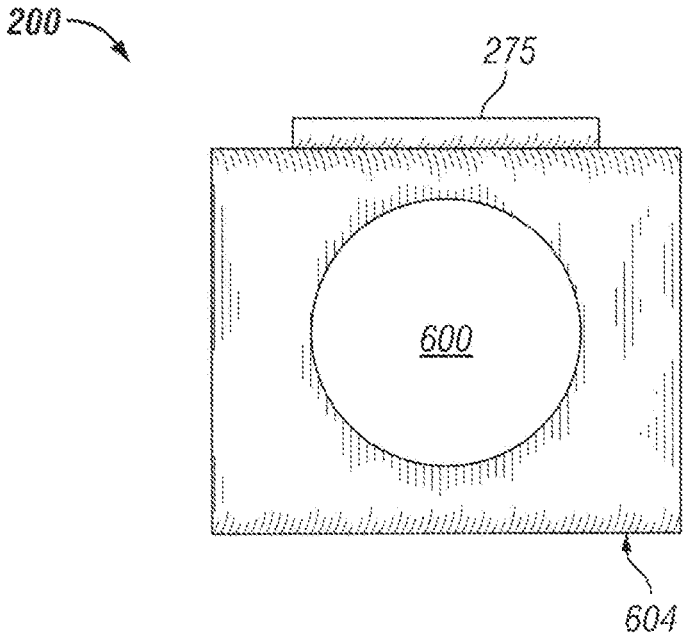
Figure 6D:
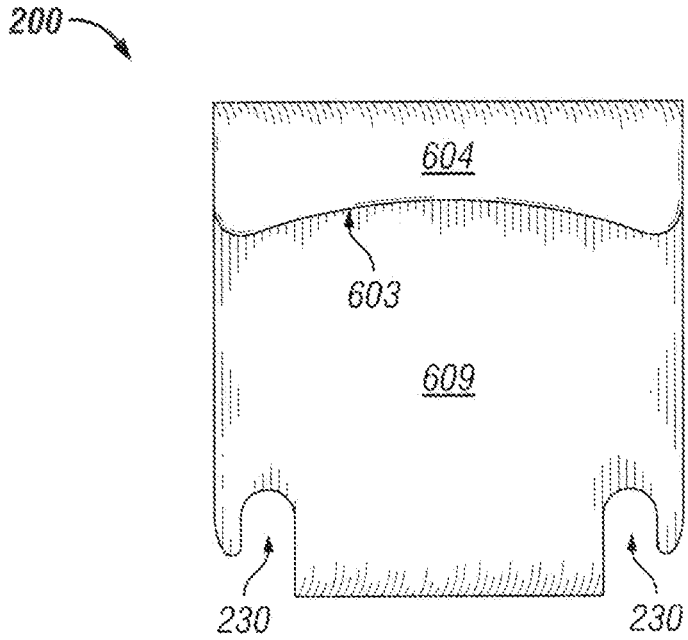
Figure 7A:
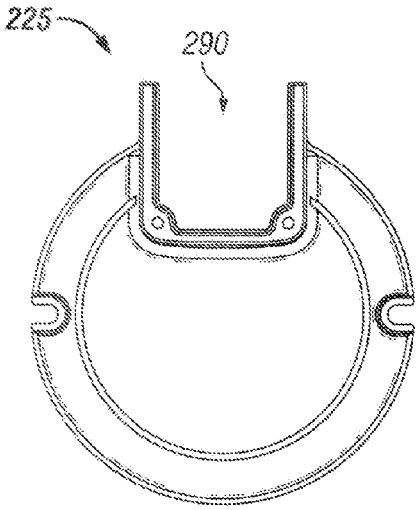
FIGS. 7A, 7B, 7C, and 7D (collectively FIG. 7) illustrate orthonormal views of the lighting-fixture side of the electrical connection system according to some example embodiments of the present technology.
Figure 7B:
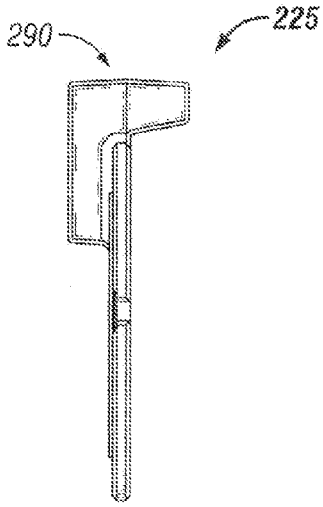
Figure 7C:
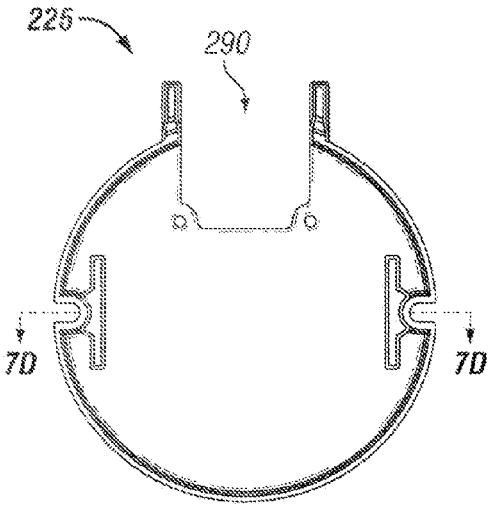
Figure 7D:
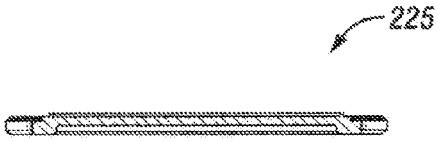

Turning now to FIG. 5, this figure provides illustrations, in two perspective views, of the example bracket 200 coupled with a conduit fastening system, as part of the electrical connection system 125, in accordance with some embodiments of the present technology.

In the illustrated embodiment, the coupler 405 extends through an aperture in the bracket 200, wherein the aperture is visible in FIG. 6 and denoted by reference number 600. The coupler 405 comprises a shoulder 501 on the conduit side of the bracket 200 and is threaded on the housing side of the bracket 200. The threads mate with a jam nut 410. When the jam nut 410 is tightened, the shoulder 501 and the jam nut 410 urge together against the bracket 200. Thus, the jam nut 410 and the shoulder 501 cooperatively retain the coupler 405 with the bracket 200.

The coupler 405 comprises an aperture 502 that receives an end of the conduit 130 (not illustrated in FIG. 5). Once the conduit 130 is inserted in the aperture 502, the screw 400 is tightened (for example with a screwdriver or other appropriate hand tool). Tightening the screw 400 advances the screw 400 into the side of the conduit 130, so that the conduit end is captured as illustrated in FIG. 4. Thus, the tightened screw 400 impinges on the conduit 130 and may seat into and deform the conduit 130.

As an alternative to the illustrated coupler 405, the conduit 130 can be attached to the bracket 200 using a conduit clip or other appropriate fastening facility known in the art. In a representative embodiment, such a conduit clip can be positioned over the end of the conduit 130, for insertion in the aperture 600 in the bracket 200. When the conduit clip and the end of the conduit 130 are inserted in the aperture 600, the conduit clip can squeeze around and grasp the conduit 130 firmly. Additionally, the conduit clip can comprise a strip of material that springs laterally outward in its relaxed state, so that the conduit clip is captured in the aperture 600 of the bracket 200 upon insertion.

Turning now to FIG. 6, this figure provides illustrations in orthonormal and perspective views of the example bracket 200 of the example electrical connection system in accordance with some embodiments of the present technology.

FIG. 6 further illustrates the extension 604 that is generally parallel to the surface 609 of the bracket 200, with the surface 609 substantially perpendicular to the aperture 600 in the illustrated embodiment. The edge 603 of the extension 604 is curved to follow and contact the side surface of the housing 200, as discussed above. Thus, the edge 603 and the side surface of the housing may have substantially matching contours. The illustrated geometries are examples; various other configurations, angles, and geometries may be utilized as appropriate.

In some example embodiments, the bracket 200 is made of a unitary metallic member that may be painted, powder coated, anodized, galvanized or otherwise surface treated, or left bare. In some embodiments, the bracket 200 is made from a single piece of sheet metal that is bent and punched for economical fabrication. In other embodiments, the bracket 200 may comprise two or more structural members that are fused, glued, welded, fastened, or otherwise joined together using appropriate joining technology known in the art.

Turning now to FIG. 7, this figure provides illustrations in orthonormal views of the lighting-fixture side of the example electrical connection system 125 in accordance with some embodiments of the present technology. More specifically, FIG. 7 illustrates an example embodiment of the cover 225 of the housing 120.

The teaching provided herein supports numerous embodiments, some of which will now be further discussed, without limitation.

Representative embodiments of a lighting connection system are described herein. In some embodiments, the lighting connection system can comprise a housing and a connector. The housing can be sized to accommodate a light source. The housing can comprise: a first aperture disposed to emit illumination produced by the light source; a first member disposed so that the light source, when installed in the housing, is between the first aperture and the first member; a second member that extends between the first member and the first aperture and that forms at least a portion of a side of the housing; and a second aperture disposed at least partially in the side of the housing. The connector can comprise: a bracket sized to cover the second aperture; a clamp that is operative to attach the bracket to a conduit; and a channel sized to pass an electrical line between the conduit and the housing.

In some embodiments of the lighting connection system, the first member comprises at least part of the second aperture. In some embodiments of the lighting connection system, the second aperture is disposed between the first member and the second member. In some embodiments of the lighting connection system, the bracket comprises a projecting edge. In some embodiments of the lighting connection system, the bracket comprises a third aperture sized to receive a fastener that attaches to the first member. In some embodiments of the lighting connection system, the bracket comprises a first region and a second region, and when the bracket is disposed to cover the second aperture, the first region adjoins the first member and the second region adjoins the second member. In some embodiments of the lighting connection system, the bracket comprises a lip that is bent for capture by a fastener that attaches to the first member.

Representative embodiments of a lighting fixture are described herein. In some embodiments, the lighting fixture can comprise a housing for a light source and a connector for an electrical supply. The housing can comprise: a lower portion that is mountable adjacent a plaster frame; an upper portion, wherein the light source is disposed between the upper portion and the lower portion; and a side portion extending between the upper portion and the lower portion and about the light source. The connector can protrude from the side portion.

In some embodiments of the lighting fixture, the side portion and the upper portion meet to form an edge, and the connector adjoins the edge. In some embodiments of the lighting fixture, the connector comprises a member that adjoins the upper portion of the housing and the lower portion of the housing. In some embodiments of the lighting fixture, the side portion comprises heat sink fins extending between the upper portion and the lower portion. In some embodiments of the lighting fixture, the connector is operable to connect a flexible conduit to the housing. In some embodiments of the lighting fixture, the connector comprises a bent lip. In some embodiments of the lighting fixture, the connector comprises a bracket, and the bracket comprises at least one slot sized according to a fastener that attaches the bracket to the housing.

Representative embodiments of a bracket for connecting an electrical supply to a lighting system are described herein. The bracket can comprise: a first flat portion that comprises a first aperture; a second flat portion that extends at an angle relative to the first flat portion and that comprises a second aperture sized to receive a fastener; and a lip operable to be retained by a head of the fastener when the fastener is disposed in the second aperture.

In some embodiments of the bracket, the angle is substantially perpendicular. In some embodiments, the bracket further comprises a third flat portion projecting from the first flat portion substantially parallel to the second flat portion. In some embodiments, the bracket further comprises a third flat portion extending from the first flat portion, the third flat portion curved according to a housing of the lighting system. In some embodiments of the bracket, the first flat portion, the second flat portion, and the lip are portions of a unitary member. In some embodiments of the bracket, a piece of sheet metal comprises the first flat portion, the second flat portion, and the lip.

Technology for connecting lighting systems to electrical supplies has been described. From the description, it will be appreciated that embodiments of the present technology overcome limitations of the prior art. Those skilled in the art will appreciate that the present technology is not limited to any specifically discussed application or implementation and that the embodiments described herein are illustrative and not restrictive. From the description of the example embodiments, equivalents of the elements shown therein will suggest themselves to those skilled in the art, and ways of constructing other embodiments of the present technology will appear to practitioners of the art.

What is claimed is:

1. A lighting connection system comprising:

a housing sized to accommodate a light source, the housing comprising:

a first aperture disposed to emit illumination produced by the light source;

a first member disposed so that the light source, when installed in the housing, is between the first aperture and the first member;

a second member that extends between the first member and the first aperture and that forms at least a portion of a side of the housing; and a second aperture disposed at least partially in the side of the housing; and a connector comprising:

a bracket sized to cover the second aperture; and a channel sized to pass an electrical line between a conduit and the housing, wherein the bracket comprises a lip that is bent for capture by a fastener that attaches to the first member.

2. The lighting connection system of claim 1, wherein the first member comprises at least part of the second aperture.

3. The lighting connection system of claim 1, wherein the second aperture is disposed between the first member and the second member.

4. The lighting connection system of claim 1, wherein the bracket comprises a projecting edge.

5. The lighting connection system of claim 1, wherein the bracket comprises a third aperture sized to receive a fastener that attaches to the first member, and wherein the connector comprises a mechanical coupling to the conduit.

6. The lighting connection system of claim 1, further comprising a plaster frame to which the housing is attached.

7. The lighting connection system of claim 1, wherein the side comprises heat sink fins extending between the first member and the first aperture.

8. A lighting connection system comprising:

a housing sized to accommodate a light source, the housing comprising:

a first aperture disposed to emit illumination produced by the light source;

a first member disposed so that the light source, when installed in the housing, is between the first aperture and the first member;

a second member that extends between the first member and the first aperture and that forms at least a portion of a side of the housing; and a second aperture disposed at least partially in the side of the housing; and a connector comprising:

a bracket sized to cover the second aperture; and a channel sized to pass an electrical line between a conduit and the housing, wherein the bracket comprises a first region and a second region, and wherein when the bracket is disposed to cover the second aperture, the first region adjoins the first member, and the second region adjoins the second member.

9. A lighting connection system comprising:

a housing sized to accommodate a light source, the housing comprising:

a first aperture disposed to emit illumination produced by the light source;

a first member disposed so that the light source, when installed in the housing, is between the first aperture and the first member;

a second member that extends between the first member and the first aperture and that forms at least a portion of a side of the housing; and a second aperture disposed at least partially in the side of the housing; and a connector comprising:

a bracket sized to cover the second aperture; and a channel sized to pass an electrical line between a conduit and the housing, wherein the bracket comprises:

a first flat portion that comprises a third aperture;

a second flat portion that extends at an angle relative to the first flat portion and that comprises a fourth aperture sized to receive a fastener; and a lip operable to be retained by a head of the fastener when the fastener is disposed in the second aperture.

10. The lighting connection system of claim 9, wherein the angle is substantially perpendicular.

11. The lighting connection system of claim 9, further comprising a third flat portion projecting from the first flat portion substantially parallel to the second flat portion.

12. The lighting connection system of claim 9, further comprising a third flat portion extending from the first flat portion, the third flat portion curved according to a housing of the lighting system.

13. The lighting connection system of claim 9, wherein the first flat portion, the second flat portion, and the lip are portions of a unitary member.

14. The lighting connection system of claim 9, wherein a piece of sheet metal comprises the first flat portion, the second flat portion, and the lip.

* * * * *